US010376105B2

(12) United States Patent
Opasik

(10) Patent No.: US 10,376,105 B2
(45) Date of Patent: Aug. 13, 2019

(54) PACK AND GO BATHTUB LINER

(71) Applicant: Cheri Opasik, Farmington Hills, MI (US)

(72) Inventor: Cheri Opasik, Farmington Hills, MI (US)

( * ) Notice: Subject to any disclaimer, the term of this patent is extended or adjusted under 35 U.S.C. 154(b) by 0 days.

(21) Appl. No.: 15/678,612

(22) Filed: Aug. 16, 2017

(65) Prior Publication Data

US 2018/0049597 A1 Feb. 22, 2018

Related U.S. Application Data

(60) Provisional application No. 62/376,088, filed on Aug. 17, 2016.

(51) Int. Cl.
*A47K 3/00* (2006.01)

(52) U.S. Cl.
CPC ..... *A47K 3/001* (2013.01)

(58) Field of Classification Search
CPC ..... A47K 3/001
USPC ..... 4/580, 581–583
See application file for complete search history.

(56) References Cited

U.S. PATENT DOCUMENTS

| | | | | | |
|---|---|---|---|---|---|
| 246,171 | A | | 8/1881 | Mansfield | |
| 2,319,603 | A | | 5/1943 | Henry | |
| 2,742,650 | A | * | 4/1956 | Mohun | A47K 13/00 4/239 |
| 3,133,292 | A | | 5/1964 | Spier | |
| 3,931,651 | A | | 1/1976 | Weir | |
| 4,047,259 | A | | 9/1977 | Lotis | |
| 5,040,252 | A | * | 8/1991 | Taggart | A47K 3/001 4/580 |
| 5,153,950 | A | | 10/1992 | Sowers | |
| 5,216,764 | A | | 6/1993 | Hall et al. | |
| 5,465,436 | A | | 11/1995 | Bleicher | |
| 5,742,955 | A | | 4/1998 | Parkay et al. | |
| 5,839,132 | A | | 11/1998 | Rooney | |
| 6,085,367 | A | * | 7/2000 | Guiste | A47K 3/002 4/546 |
| 6,336,231 | B1 | * | 1/2002 | Smith | A47K 3/001 4/573.1 |
| 6,463,598 | B1 | * | 10/2002 | David | E03C 1/0404 4/541.3 |
| RE38,782 | E | | 8/2005 | Dix | |
| 2005/0188458 | A1 | * | 9/2005 | Dickstein | A47K 3/002 4/583 |
| 2007/0113334 | A1 | * | 5/2007 | Bowers | A47K 3/001 4/580 |
| 2014/0026314 | A1 | * | 1/2014 | Zuravsky | A47K 3/001 4/581 |

* cited by examiner

*Primary Examiner* — Christine J Skubinna
(74) *Attorney, Agent, or Firm* — Carlson, Gaskey & Olds, P.C.

(57) ABSTRACT

The disclosed pack and go bathtub liner forms a barrier between a user and the surfaces of a bathtub, is reusable, washable and covers all surfaces of a bathtub. The pack and go bathtub liner is fabricated from a non-toxic, anti-microbial, waterproof material that defines a watertight volume within a separate from a bathtub. The liner is packable into an easily transportable package. The pack and go bathtub liner provides a barrier to contaminants that may exist within a bathtub and prevents contact with a person or children within the bathtub to provide peace of mind to parents wary of the cleanliness of unfamiliar bathtubs.

24 Claims, 6 Drawing Sheets

PACK AND GO BATHTUB LINER

CROSS REFERENCE TO RELATED APPLICATION

This application claims priority to U.S. Provisional Application No. 62/376,088 filed on Aug. 17, 2016.

BACKGROUND

Parents of small children are more aware then ever of germs, bacteria and other transmitters of potentially infectious disease surrounding their children. Although a parent can ensure that their home is free of such potential harmful germs and bacteria, when traveling, such assurances are not possible. A common question when traveling is how clean are the hotel bathrooms and especially the bathtub?

Unfortunately, it is now widely known and understood that hotel rooms may not be cleaned as well as everyone would like and some forms of bacteria can survive on common surfaces. The spread of infectious diseases in hotel bathrooms is well documented. Studies have shown that viruses and bacteria can survive on common hotel surfaces for as long as four days. Bacteria, including aerobic bacteria's-Staphylococcus Species, Streptococcus Species, Enterobacteriaceae Species and Coliform Bacteria may be unknowingly present in a hotel room.

Ideally, all bathroom surfaces including showers and bathtubs should be thoroughly cleaned and disinfected after a guest leaves in preparation for the next guest. It is common sense to believe that the toilet and shower may be the least clean parts of a hotel room. Studies have shown that bathtubs and whirlpool tubs are notorious breeding grounds for potentially harmful substances. In one study, water samples taken from different hotel whirlpool tubs tested positive for agents that can cause rashes, urinary tract infections, or pneumonia.

Even a thorough cleaning is not a guarantee that all bacteria is removed. Typically, the unseen parts of the tub such as the pipes and tubing in the case of a whirlpool tub provide locations for the harmful agents to thrive. This means that even if the tub itself is thoroughly cleaned harmful agents may still be present and directly contact a user once water is run through the pipes. Additionally, even if the tubs are cleaned, the same cleaning products that rid the tubs of germs can leave behind a residue that can cause allergic reactions. Moreover, mops and sponges are used to clean more than room and therefore may transfer germs and bacteria between rooms.

Even if facilities are cleaned with all the precautions required to prevent the spread of disease, there is no way to confirm cleanliness. Parents may still be weary of placing children in an unknown bathtub because there is simply no means to easily verify the cleanliness of an unknown bathroom.

Parents therefore have a well-founded concern over bathing children in an unknown bathtub. Options available to parents for assuring a desired level of cleanliness include carrying cleaning products to clean and sanitize the unknown bathtub, placing towels within the tub to create a barrier and/or bringing their own inflatable tub. Carrying cleaning products during travel is difficult as typically, space is limited and travel restrictions may not allow transport of some cleaning products. The use of towels is not practical and does not cover all surfaces of a bathtub. An inflatable tub is bulky to transport, and time consuming to properly inflate. Moreover, a common problem with each of these alternatives is that they are extremely inconvenient and do not fit into a typical hectic travel schedule and therefore would not typically be utilized.

Liners of bathtubs are generally known, for example, one such liner entitled "Bathroom Safety Liner" disclosed in U.S. Pat. No. 3,133,292 to Spier provides a padded liner installed within a bathtub and intended to prevent impact against the hard surface of the tub. The Spier liner is not easily installed or removed.

Bathtub liners are also known for use in medical environments. For example, U.S. Pat. No. 5,465,436 to Bleicher discloses a disposable tank liner intended to isolate the tank from hydrotherapy fluids. The Bleicher liner includes a ripcord assembly that enable removal of a portion of the liner to form a drain hole to remove water from within the liner. Accordingly, the Bleicher liner may only be utilized once and is not easily transportable.

Another proposed liner entitled "Bathing Facility Liner Ensemble" is disclosed in U.S. Patent Application No. 2005/0188458 to Dickstein. The Dickstein liner also includes a ripcord for ripping a drain opening in the bottom of the liner. Additionally, the Dickstein liner includes a mat formed of material heavier than that of sidewalls. The mat is intended to provide some cushioning. Accordingly, the Dickstein liner provides a single use liner that is bulky to transport.

Other liners include inflatable bladders that are intended to provide comfort rather than prevent contact with potentially non-hygienic surfaces. One example liner is disclosed in U.S. Pat. No. 5,839,132 to Rooney. The Rooney liner includes inflatable bottom and sidewalls that fit within a bathtub. Such inflatable liners require time-consuming inflation. Moreover, the Rooney liner is formed of a material intended for disposal after use.

Accordingly, there exists a need for a solution that provides a safe environment for bathing children in different bathtubs of unknown cleanliness and demand for a solution that provides a parent with control over exposure in unfamiliar environments that is transportable, easily installed and reusable.

SUMMARY

The disclosed Bath Pack is a pack and go bathtub liner that forms a barrier between a user and the surfaces of a bathtub, is reusable, washable and easily transportable. The Bath Pack bathtub liner is fabricated from a non-toxic, anti-microbial, waterproof material that defines a watertight volume within and separate from a bathtub. The liner is packable into an easily transportable package. The Bath Pack bathtub liner provides a barrier to contaminants that may exist within a bathtub and prevents contact with a person or children within the bathtub to provide peace of mind to parents wary of the cleanliness of unfamiliar bathtubs.

The disclosed liner includes a bottom portion for covering a bottom surface of a bathtub and at least one side portion for covering side surfaces of the bathtub. The bottom portion and the at least one side portion form the watertight volume within and separate from the bathtub. The bottom and side portions are foldable into a small package that is secured with a clasp and provides a convenient and easily transportable accessory.

The disclosed pack and go liner is fabricated from material that enables reuse and that is free from toxic materials, animal products and is non-flammable. The material is lined or coated on a bottom surface to prevent slipping of the liner within the bathtub. The liner further includes internal traction portions that prevent slipping of those within the tub. Additionally, the material enables the use of colors and patterns to appeal to children and make bath time fun and enjoyable while providing parents the comfort and ease of mind knowing that their child is protected from potentially harmful agents. Moreover, the pack and go liner is fabricated from environmental friendly materials and is reusable to appeal to consumers that seek to reduce an impact on the environment.

Accordingly, the disclosed pack and go liner provides a unique barrier within a bathtub that is easily transportable, convenient, easy to use, easy to clean, machine washable, quick to dry, reusable and cost effective.

Although the different examples have the specific components shown in the illustrations, embodiments of this disclosure are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
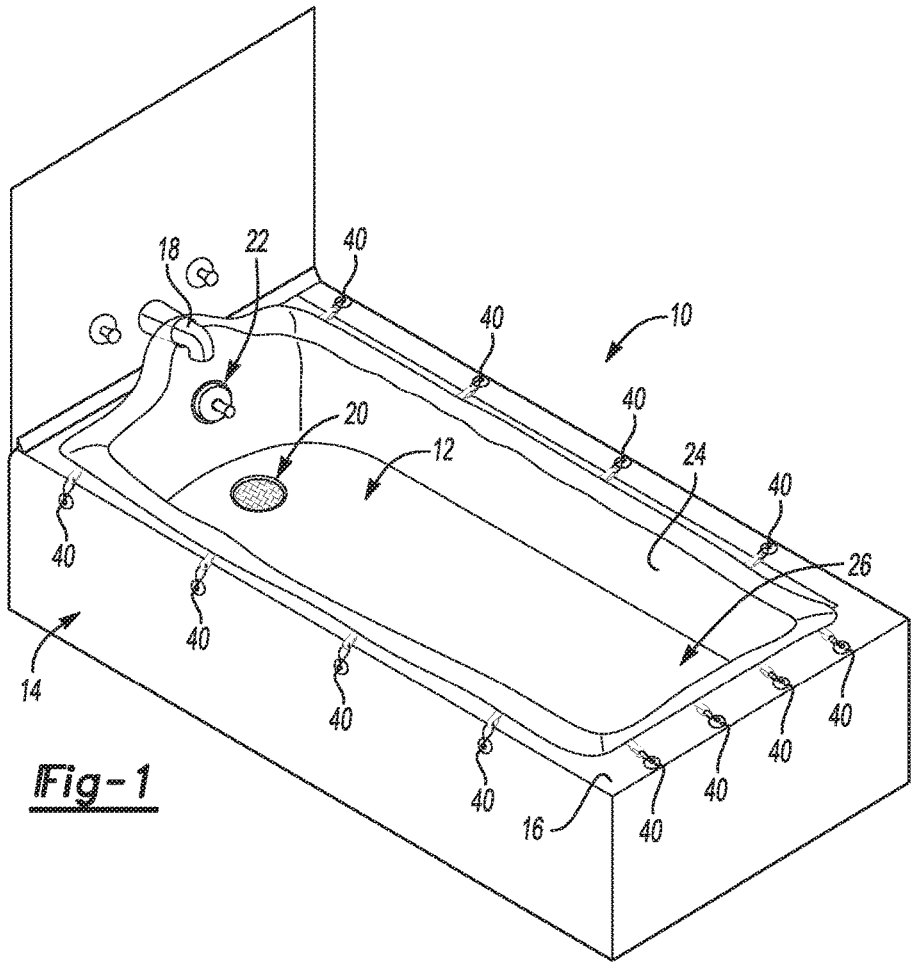
FIG. 1 is a schematic view of an example liner installed within a bathtub.

Referring to FIG. 1, an example bathtub liner 24 is shown installed within a bathtub 10. The bathtub 10 includes a bottom surface 12, side surfaces 14 and a top surface 16. The liner 24 includes a bottom portion 26 and at least one side portion that covers the interior surfaces of the bathtub 10. The liner 24 covers the interior surfaces of the bathtub 10 and creates a watertight volume separate from the bathtub and within the bathtub. Because the liner 24 covers all surfaces of the bathtub 10, the only limit to the protected volume is the size of the bathtub. 10. Accordingly, multiple people, or children may fit within the confines of the liner 24 at the same time. The only constraint is the size of the bathtub 10.

The liner 24 provides a barrier between occupants and all surfaces 12, 14 of the bathtub 10. This barrier provides and prevents any germs, bacteria, spreaders of disease as well as any other known non-hygienic material from interfering or contacting an occupant of the bathtub. The liner 24 further prevents contact with residue of any harsh cleaning compounds that may cause allergic reaction in an occupant of the bathtub 10.

The example liner 24 includes features that enable reuse and make transportation easy, convenient and practical. The liner 24 folds up into a neat and easily packable size so that it can be taken anywhere that cleanliness of a bathtub is not certain.

The example liner 24 is held within the bathtub by a plurality of fasteners 40 that are secure to a surface of the bathtub 10 or a surface surrounding the bathtub 10. In the disclosed example, fasteners 40 are secured to both side and top surfaces 14, 16 of the bathtub 10 to hold the liner 24 in position during use. The liner 24 may also be formed with a self-sticking material along one side that temporarily adheres to all surfaces of the bathtub. The self-sticking material is either part of the material or coated and does not leave a residue once removed. Moreover, the self-sticking material is machine washable to enable multiple usages.

Figure 2:
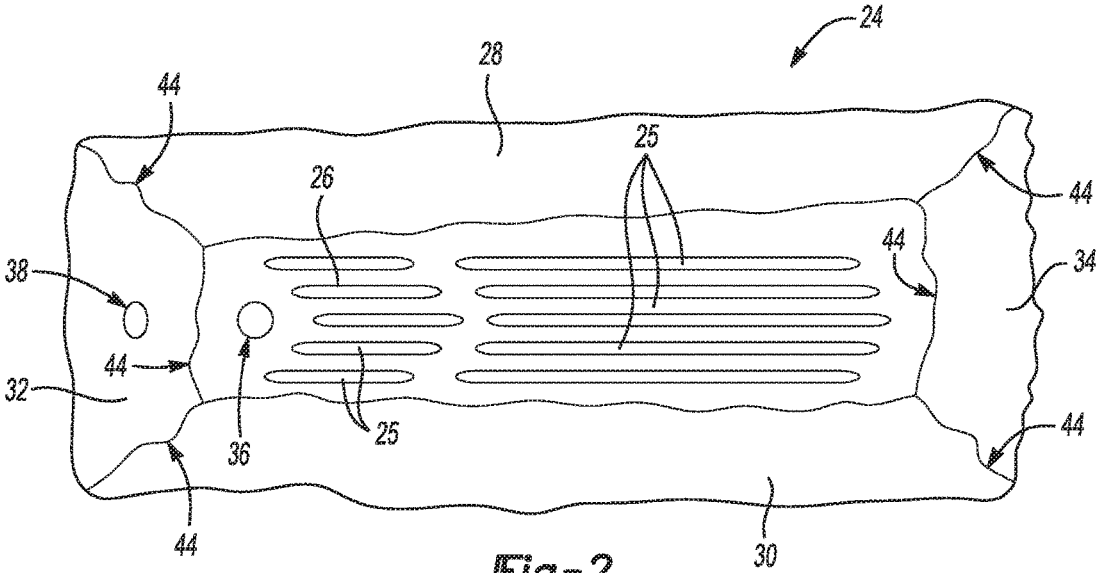
FIG. 2 is a schematic view of an example bathtub liner.
Figure 3:
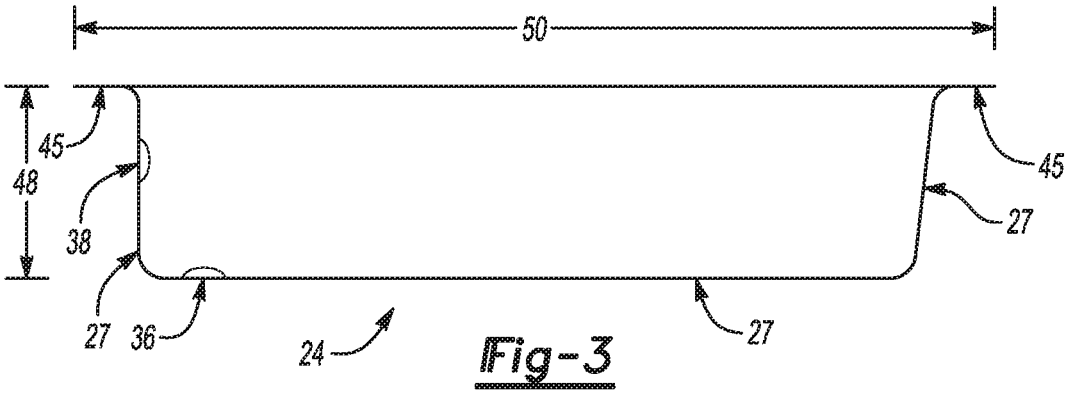
FIG. 3 is a side view of an embodiment of a bathtub liner.
Figure 4:
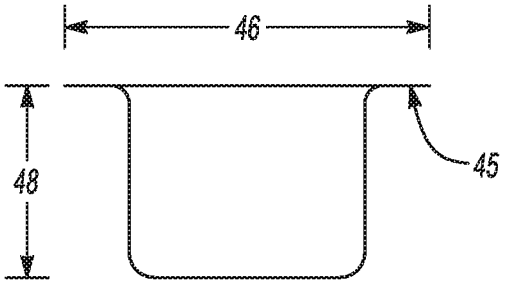
FIG. 4 is an end view of the example bathtub liner.

Referring to FIGS. 2, 3 and 4 with continued reference to FIG. 1, the example liner 24 is fabricated from a waterproof material that holds water within the liner 24. The material is formed into a bottom portion 26 that is attached to at least one side portion. In the disclosed example, a first side portion 28, a second side portion 30, a first end portion 32 and a second end portion 34 are attached to the bottom portion 26 to define the entire liner structure. It should be understood, that the number of sides, or sections may vary to accommodate varying liner configurations and are still within the contemplation of this disclosure.

The sides 28, 30 and ends 32, 34 are attached to each other at a corresponding plurality of seams 44. The seams 44 between the sides 28, 30, ends 32, 34 and bottom 26 provide a water tight joint and prevent leaking through the liner 24, as well as leaking or seepage into the liner 24.

The liner 24 including the sides 28, 30 and ends 32, 34 is formed of a material that is anti-microbial, waterproof, non-toxic, washable, and reusable and may be self-adhering to sides of the bath tub. One example material is a coated fabric. The fabric is coated with a flexible polyurethane material. The example fabric is waterproof, breathable and soft. In one disclosed example embodiment, the material of the liner is a lightweight polyester knitted fabric. The fabric is bonded to a thermoplastic polyester in the form of a thin stretchy film. The thin stretchy film is bonded to the knitted fabric using a combination of heat, pressure and an adhesive. The resulting material provides a soft, waterproof and stretchy fabric. Moreover, the disclosed material is free of toxins and solvents. The material is sufficiently flexible to enable folding into a small transportable package. The material may also be printed in a desired pattern or color that provides a desirable appearance and environment for a child at bath time.

The bottom 26 includes traction strips 25 that are applied in a pattern to prevent slippage of an occupant during a bath.

The traction strips 25 are integrally formed within the bottom 26, or alternatively attached to the bottom surface 26. The traction strips 25 are made from a gripping material that inhibit slipping when in contact with a body of a user within the bathtub 10.

As appreciated, some water may become contained between the liner 24 and the bathtub 10. This water would be exposed to anything on the surface of the bathtub 10. Accordingly, not only does the liner 24 keep water within the liner 24, but also keeps water from outside the liner 24 from leaking into the liner 24. An outer surface or backside 27 of the liner 24 includes an anti-skid coating in one example embodiment.

The bottom 26 is provided with a drain assembly 36 that further provides for keeping water in the liner 24. Moreover, the example drain assembly 36 keeps occupants within the liner 24 separate from the drain 20 of the bathtub 10. Similarly, the first end 32 includes an overflow opening 38 that corresponds with an overflow valve 22 of the bathtub 10. The example liner 24 provides the corresponding overflow opening 38 that prevents errant overflow of water within the liner 24 by enabling use of the bathtubs overflow opening.

Figure 5:
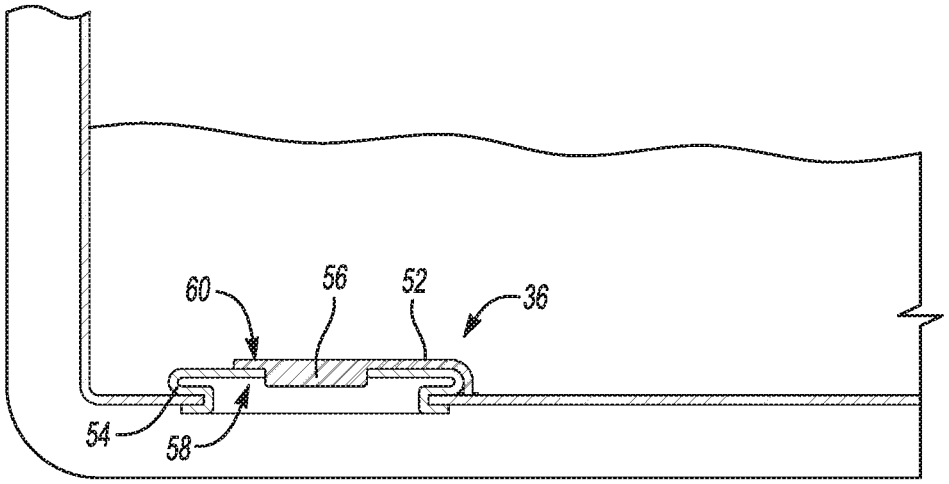
FIG. 5 is a side view of a drain portion of the example liner in a closed position.
Figure 6:
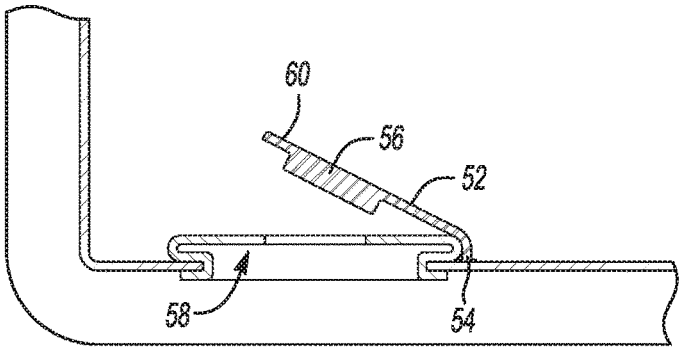
FIG. 6 is a side view of the drain portion of the example liner in an open position.
Figure 7:
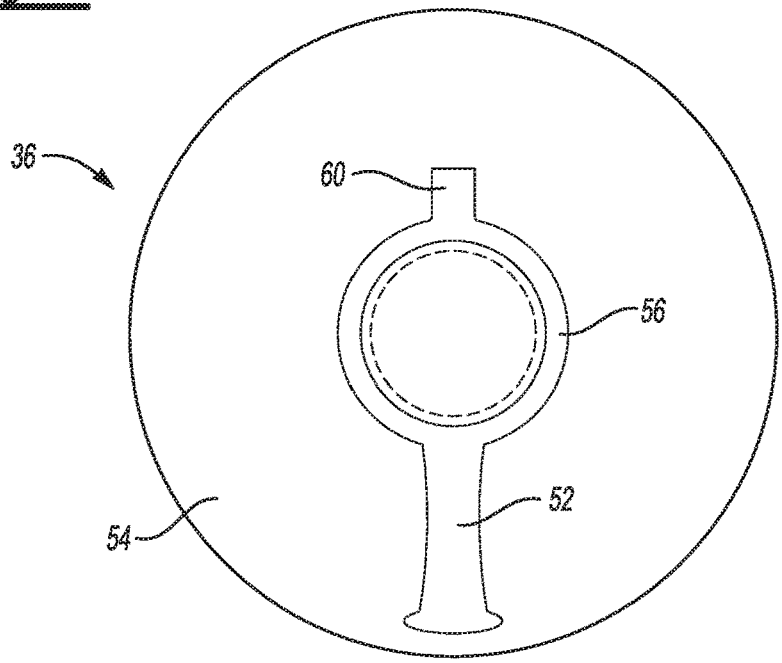
FIG. 7 is a top view of the example drain.

Referring to FIGS. 5, 6 and 7 with continued reference to FIG. 1, the example drain assembly 36 is schematically illustrated in FIG. 5 in a closed position and in an open position in FIG. 6.

The example drain assembly 36 is formed of a flexible plastic material that is adhered, sewn or otherwise attached to the lining material. The drain assembly 36 includes a body 54 formed from a flexible plastic material attached to the liner 24 proximate the drain of the bathtub. The body 54 includes an opening 56 and a plug 58 made of the same flexible plastic material that fits within the opening 56. The plug 58 is attached to the body 54 through an arm 52. The arm 52 keeps the plug 58 attached to the body 54 when in the open position shown in FIG. 6. The opening 56 and plug 58 are sized to provide a watertight interference fit when in the closes position shown in FIG. 5. The plug 58 includes a tab 60 that is pulled to free the plug 58 from the opening 56 and allow water to drain from within the liner 24.

Figure 8:
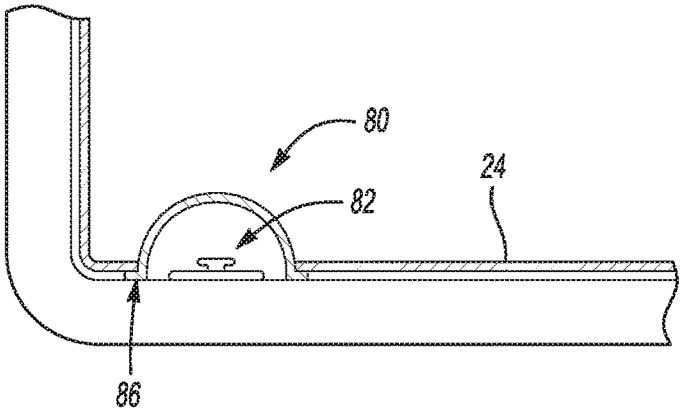
FIG. 8 is a side view of another example drain embodiment.
Figure 9:
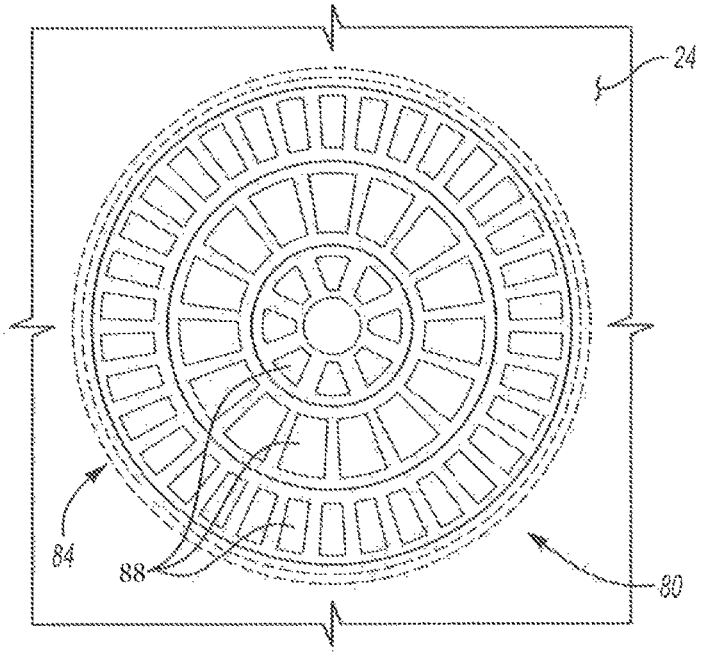
FIG. 9 is a top view of the example drain embodiment shown in FIG. 8.

Referring to FIGS. 8 and 9, another drain assembly embodiment 80 is shown and is made from a soft silicone or like material that is attached to the liner 24. In the disclosed example, stitches 84 are utilized to hold the drain assembly 80 to the liner 24. The drain assembly 80 is a semi-spherical shape that fits over the tubs normal drain 82. A bottom surface 86 of the drain assembly 80 adheres to the bottom of the tube and provides a substantially water tight seal that prevents water from accumulating between the liner 24 and the bottom surface of the tub. Once the user is finished with the bath, the bathtub drain 82 is opened and water is drained through openings 88 in the drain assembly 80. The drain assembly 80 is sufficiently soft and flexible to allow grasping or pushing on the bathtub drain 82 as required to open and drain water from the liner 24.

Figure 10:
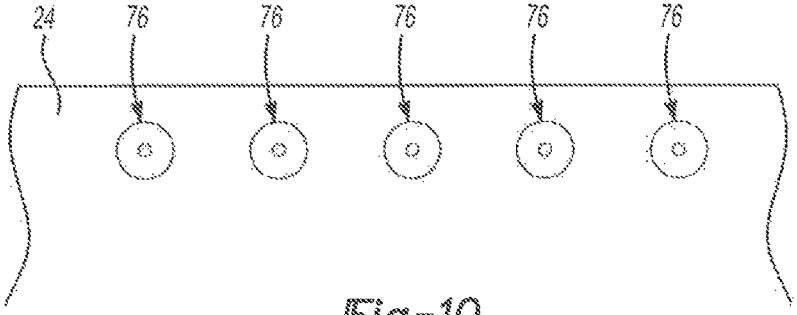
FIG. 10 a schematic view of integral suction cups for securing the example liner.

Referring to FIG. 10, the liner 24 may include integral suction cups 76 to hold the liner 24 in place within the bathtub. The suction cups 76 are located and spaced about the liner 24 to maintain a position within the bathtub. The suction cups 76 may be sewn to the liner to provide a permanent attachment means. The suction cups 76 may also be adhered using a waterproof adhesive. It should be understood, that the suctions cups 76 might be attached to the liner 24 by other known means suitable to the bath environment and capable of being machine washed with the liner 24.

Figure 11:
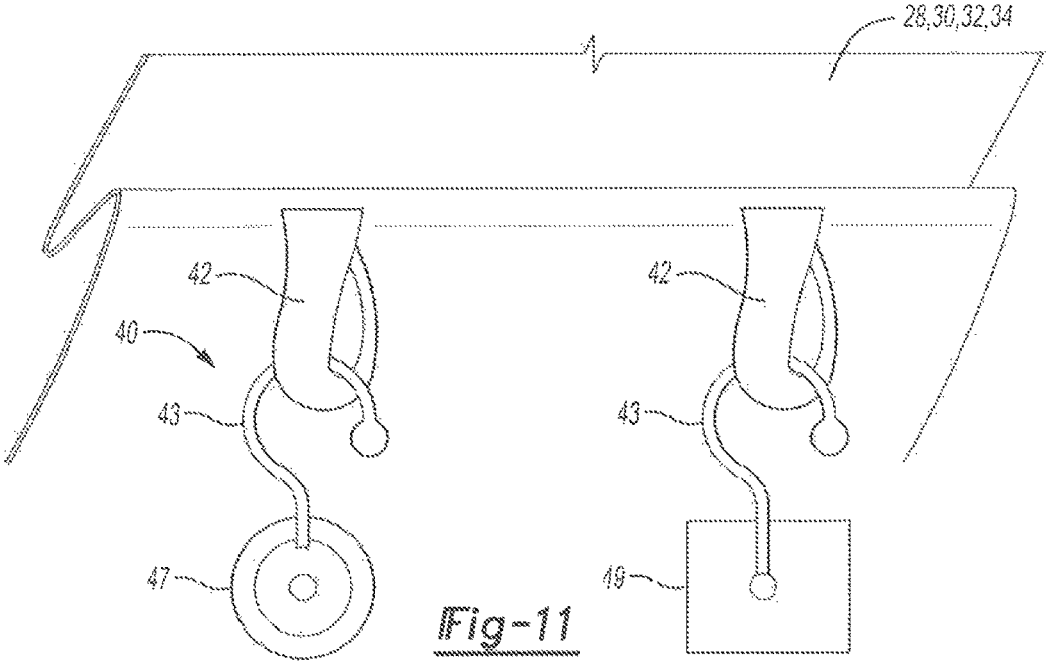
FIG. 11 is an enlarged view of an example fastener for the example liner.

Referring to FIG. 11 with continued reference to FIG. 1, other possible fasteners 40 are shown and maybe disposed about the perimeter of the liner 24 include loops 42 that are adhered to the liner 24. The loops 42 maybe stitched, glued, heat stacked or attached in any other known manner using known processes. The loops 42 may be fabricated of the same material as used to fabricate the liner 24, or from a different material. Whatever variation of material is utilized, the loops 42 will be of type that is anti-microbial.

A fastener is attached to the bathtub 10 or surface surrounding the bathtub 10 and includes a hook 43. The hook 43 attaches through the loop 42 to secure the liner 24 within the bathtub 10. In one example, the hook 43 is attached to a suction cup 47 that adheres to a side of the bathtub. In another example, the hook 43 is adhered to an adhesive patch 49 that adheres to sides of the bathtub 10.

As appreciated, the use of fasteners 40 (FIG. 11, or the suction cups 76 (FIG. 10) are one disclosed means of securing the liner 24 within the bathtub 10. The fasteners 40 and suction cups 76 may not be necessary if the liner 24 is provided with a bottom surface that is lined or coated with a self-sticking material that temporarily adheres the liner 24 to the sides of the bathtub 10. In one example disclosed embodiment, the liner 24 is coated on surfaces that touch the bathtub with a non-skid material schematically indicated at 27 in FIG. 3. The non-skid material 27 can be coated on all surface of the liner 24 that touch the bathtub 10, or strategically located on only some of the surfaces to hold the liner 24 in place.

Figure 12A:
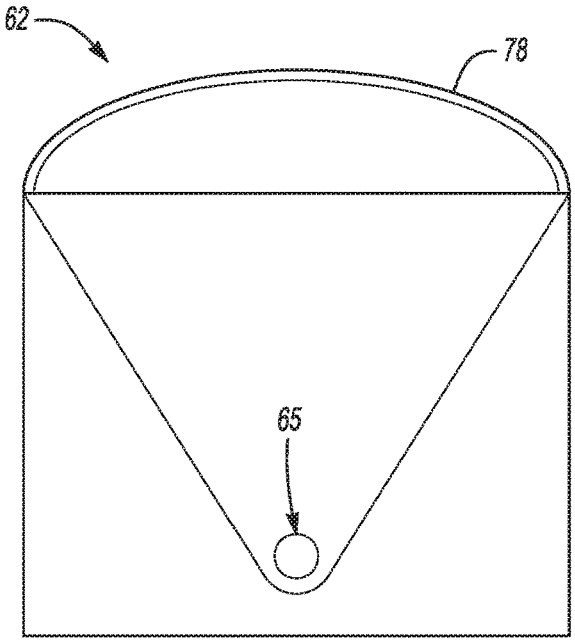
FIG. 12A is the liner shown in a folded configuration.
Figure 12B:
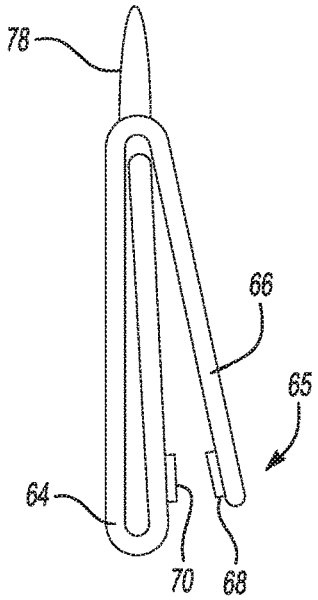
FIG. 12B is a side view of the liner in the folded configuration.

Referring to FIGS. 12A and 12B, with continued reference to FIG. 1, the example liner 24 is shown in a folded configuration 62. In the folded configuration, the liner 24 is folded over and onto itself into an area much smaller than when the liner 24 is extended and laid out in the bathtub 10. A clasp 65 is orientated based on the folded configuration for holding the liner 24 in the folded configuration shown at 62. A handle 78 is also provided that is accessible when in the folded configuration 62. In this example, the folded configuration 62 includes a first portion 64 that includes a first part of a clasp 70 and a second portion 66 that includes a second portion 68 of the clasp 65. The second portion 66 is a flap that folds over the bundled parts of the liner 24. The folding capability of the liner 24 provides portability function to the liner 24 that encourages use and provides an easily packable size.

The example clasp 65 may include a metal buckle, a magnetic clasp, a hook and loop fabric fastener, a button and loop or slot. In any configuration, the clasp 65 provides for the folded configuration 62 to remain folded as it is being transported.

Referring to FIGS. 13A-E, the example liner 24 is foldable to enable reuse and simple storage such that it may be taken with a parent or other adult while traveling. Because the example liner 24 is portable and of a manageable size once in the folded configuration (FIGS. 12A and 13E), it can be taken with a person while traveling to enable them to utilize the liner in any bathtub to provide peace of mind that any type of contamination is not an issue.

Figures 13A, 13B, 13C, 13D, 13E:
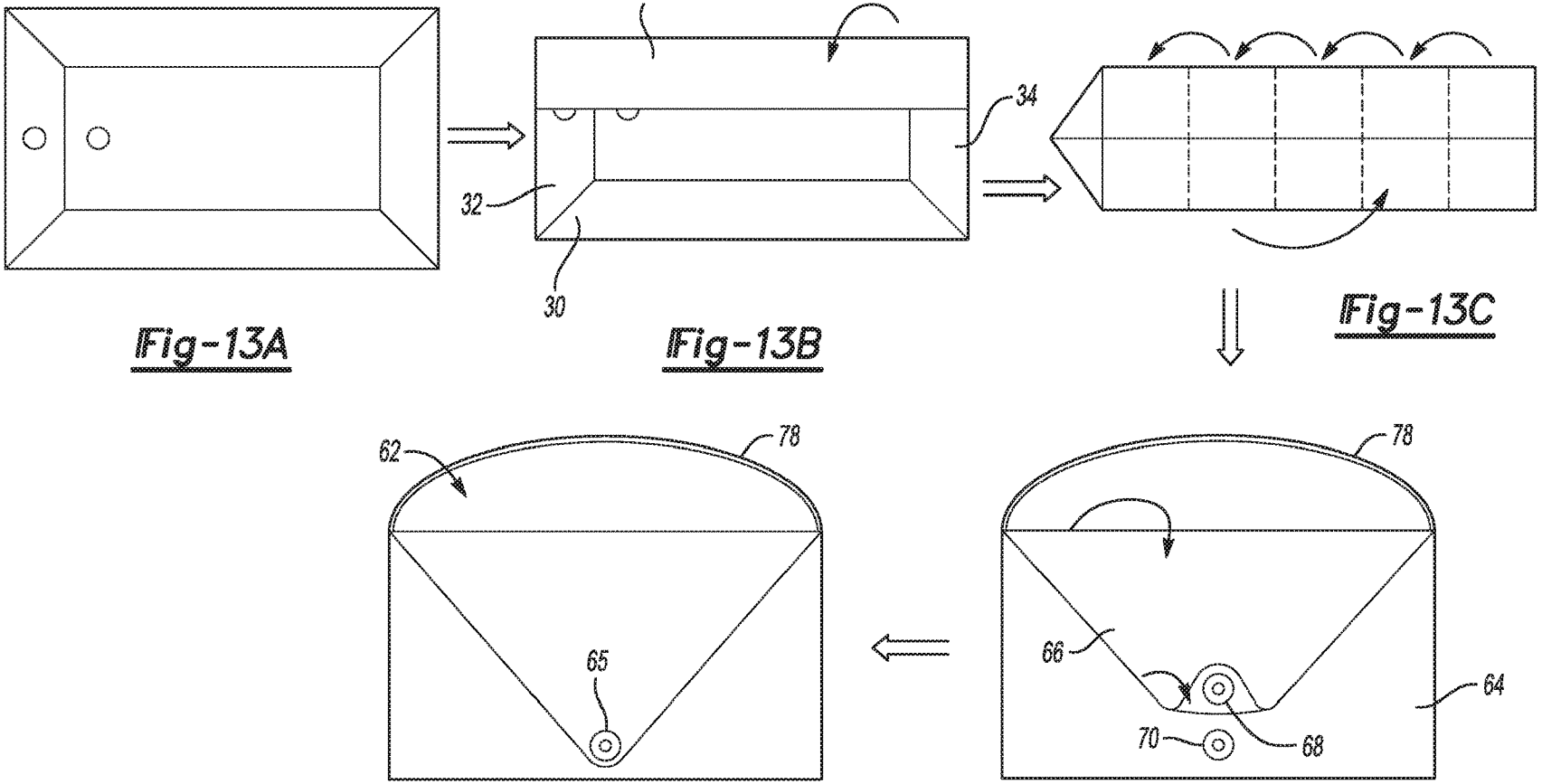
FIG. 13A is a first step in folding the liner
FIG. 13B is a view of a first fold for folding the example liner.
FIG. 13C is an example view of continued folds for folding the example liner.
FIG. 13D is a view of a final fold for folding the example liner.
FIG. 13E is a view of the liner in a completed folded configuration.

In this example, sides 28 and 30 of the liner 24 are folded over itself as is shown in FIG. 13B. The liner 24 is further folded onto itself according to one example as shown in FIG. 13C. A final fold is formed with the liner 24 to define the first portion 64 and the second portion 66 that forms the flap with the second part 68 of the clasp 65. The final fold includes the second part 68 of the clasp 65 engaging the first part 70 of the clasp 65 to secure the liner 24 in the folded configuration as is shown in FIG. 13E. It should be understood that the example method and seems for folding are one disclosed embodiment and other fold configurations are within the contemplation of this disclosure.

The example liner assembly is made from a material that provides a waterproof barrier that enables the liner to hold a volume of water while within the bathtub but separate from the bathtub. The material is also anti-microbial so that it prevents the spread and propagation of germs and other bacterium that may spread diseases or other infections. The material further enables washing or autoclaving to remove any bacteria.

Figure 14:
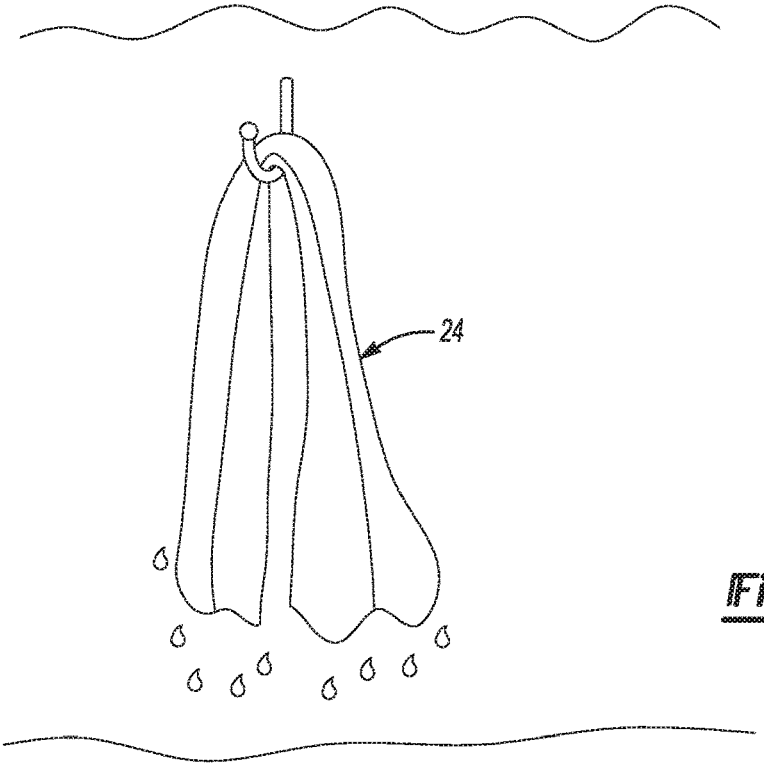
FIG. 14 is a schematic view of an example liner hanging to dry.

Additionally, referring to FIG. 14, the liner 24 maybe hung over a hook to drip try. The liner 24 may include an opening, or loop to provide for hanging or because it is fabricated from a flexible cloth like material, simply draped over at hook or shower curtain bar to dry.

The material is provided with a cloth like feel that is both comfortable and flexible to conform to the inner surfaces of the bathtub. The liner 24 may include a pleasing color or pattern that is both colorful and pleasing to children to encourage children to look forward to bath time, no matter what the location.

Accordingly, the disclosed pack and go liner 24 provides a compact, packable, and functional child accessory that provides a barrier to unfamiliar surfaces, while providing peace of mind to parents and enticement to children to look forward to bath time.

Although an example embodiment has been disclosed, a worker of ordinary skill in this art would recognize that certain modifications would come within the scope of this disclosure. For that reason, the following claims should be studied to determine the scope and content of this disclosure.

What is claimed is:

1. A reusable bathtub liner comprising:

a bottom portion for covering a bottom surface of a bathtub;

at least one side portion for covering side surfaces of the bathtub, wherein the bottom portion and the at least one side portion form a water tight volume within and separate from the bathtub, such that water does not contact surfaces of the bathtub;

a clasp for securing one portion of the liner to another portion of the liner for holding the liner in a folded configuration, wherein the folded configuration includes overlapping portions of the bottom portion and the side portion such that the liner forms an area less than an area of any one of the bottom portion or the at least one side portion; and a drain assembly attached to the bottom portion, the drain assembly comprising a semi-spherical shape that extends through an opening in the bottom portion, the semi-spherical shape of the drain assembly fits over a bath tub drain and is flexible to enable operation of the bathtub drain through the semi-spherical shape.

2. The reusable bathtub liner as recited in claim 1, including a drain opening in the bottom portion, the drain selectively movable from an open position enabling water flow from within the liner to a drain of the bathtub and a closed position preventing water flow from within the liner.

3. The reusable bathtub liner as recited in claim 2, including an overflow opening to prevent water from exceeding a capacity of the bathtub.

4. The reusable bathtub liner as recited in claim 1, wherein the at least one side portion comprises a first side panel, a second side panel, a first end panel and a second end panel all attached to the bottom section.

5. The reusable bathtub liner as recited in claim 4, wherein the first side panel, the second side panel, the end panel and the second end panel are sized such at a portion of each panel overlaps a top surface of the bathtub.

6. The reusable bathtub liner as recited in claim 1, including a plurality of fasteners for securing the liner within the bathtub.

7. The reusable bathtub liner as recited in claim 6, wherein the plurality of fasteners comprise a loop attached to the liner and securable to an attachment member secured to one of a bathtub and a surface surrounding the bathtub.

8. The reusable bathtub liner as recited in claim 7, wherein the attachment member comprises a suction device.

9. The reusable bathtub liner as recited in claim 1, including at least one seam between the bottom section and the at least one side section, wherein the at least one seam is sealed to prevent leakage.

10. The reusable bathtub liner as recited in claim 1, wherein the liner comprises a material including an antiskid coating on a back side of the liner that contacts a surface of the bathtub.

11. The reusable bathtub liner as recited in claim 1, including anti-slip strips disposed on a surface of the liner for preventing slipping of a user within the bathtub.

12. The reusable bathtub liner as recited in claim 1, including at least one opening configured to enable hanging of the liner to dry.

13. A reusable bathtub liner comprising:

a bottom panel for covering a bottom surface of a bathtub;

at least one side panel attached to the bottom panel for covering side surfaces of the bathtub, wherein the bottom panel and the at least one side panel define a water tight volume within and separate from the bathtub such that water does not contact surfaces of the bathtub and the bottom panel and the at least one side panel comprise an anti-microbial material;

a clasp for securing one portion of the liner to another portion of the liner for holding the liner in a folded configuration, wherein the folded configuration includes overlapping portions of the bottom panel and the side panel such that the liner forms an area less than an area of any one of the bottom panel and the at least one side panel; and a drain assembly attached to the bottom portion, the drain assembly comprising a semi-spherical shape that extends through an opening in the bottom portion, the semi-spherical shape of the drain assembly fits over a bath tub drain and is flexible to enable operation of the bathtub drain through the semi-spherical shape.

14. The reusable bathtub liner as recited in claim 13, including a drain opening in the bottom panel and an overflow opening in the at least one side panel, including drain plug that is selectively movable from an open position enabling water flow from within the liner to a drain of the bathtub and a closed position preventing water flow from within the liner to drain out of the bathtub and the overflow opening to prevent water from exceeding a capacity of the bathtub.

15. The reusable bathtub liner as recited in claim 13, wherein the at least one side panel comprises a first side panel, a second side panel, a first end panel and a second end panel all joined at corresponding seams to the bottom section and each other to define the water tight volume.

16. The reusable bathtub liner as recited in claim 15, wherein the first side panel, the second side panel, the end panel and the second end panel are sized such at a portion of each panel overlaps a top surface of the bathtub.

17. The reusable bathtub liner as recited in claim 13 wherein the clasp comprises a fabric hook and loop attachment.

18. The reusable bathtub liner as recited in claim 13, wherein the clasp comprises a button.

19. The reusable bathtub liner as recited in claim 13, including a plurality of loops attached to the liner and securable to an attachment member secured to one of a bathtub and a surface surrounding the bathtub for securing the liner within the bathtub.

20. The reusable bathtub liner as recited in claim 13, wherein the bottom panel and the at least one side panel comprise lined or coated waterproof material.

21. The reusable bathtub liner as recited in claim 13, including a handle accessible when the liner is in the folded configuration for easing carrying of the liner.

22. The reusable bathtub liner as recited in claim 1, wherein the semi-spherical shape includes a plurality of openings spaced circumferentially about the semi-spherical shape for draining water from the bathtub liner.

23. The reusable bathtub liner as recited in claim 1, wherein the drain assembly includes a bottom surface that seals against a surface of the bathtub to form a water tight seal between the drain assembly and the bathtub that prevents water from accumulating between the bathtub and the bathtub liner.

24. The reusable bathtub liner as recited in claim 13, wherein the drain assembly includes a bottom surface that seals against a surface of the bathtub to form a water tight seal between the drain assembly and the bathtub that prevents water from accumulating between the bathtub and the bathtub liner.

* * * * *